US008903288B2

(12) United States Patent
Matayoshi

(10) Patent No.: US 8,903,288 B2
(45) Date of Patent: Dec. 2, 2014

(54) INTERMEDIATE TRANSFER BELT AND TANDEM COLOR IMAGE FORMING APPARATUS

(75) Inventor: Akira Matayoshi, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 106 days.

(21) Appl. No.: 13/596,377

(22) Filed: Aug. 28, 2012

(65) Prior Publication Data

US 2013/0051872 A1 Feb. 28, 2013

(30) Foreign Application Priority Data

Aug. 31, 2011 (JP) ..... 2011-188538

(51) Int. Cl.
*G03G 15/01* (2006.01)
*G03G 15/16* (2006.01)

(52) U.S. Cl.
CPC ..... *G03G 15/162* (2013.01); *G03G 2215/0132* (2013.01); *G03G 15/0189* (2013.01)
USPC ..... 399/302

(58) Field of Classification Search
USPC ..... 399/302
See application file for complete search history.

(56) References Cited

U.S. PATENT DOCUMENTS 5,832,351 A * 11/1998 Takekoshi et al. ..... 399/303
2004/0141775 A1* 7/2004 Sakai ..... 399/297
2008/0166143 A1* 7/2008 Watanabe et al. ..... 399/27

FOREIGN PATENT DOCUMENTS

JP H11-212371 8/1999
JP 2005-31176 2/2005
JP 2005-099181 4/2005
JP 2006156163 A * 6/2006

OTHER PUBLICATIONS

Machine translation of Mukoyama et al., JP 2006-156163.*
Kasap and Capper, Springer Handbook of Electronic and Photonic Materials, Springer, New York (2006) § 2.8, Table 2.6 "Resistivity mixture rule".*

* cited by examiner

*Primary Examiner* — David Gray
*Assistant Examiner* — Sevan A Aydin
(74) *Attorney, Agent, or Firm* — Pearl Cohen Zedek Latzer Baratz LLP

(57) ABSTRACT

An intermediate transfer belt that temporarily holds a toner image which is formed on an image carrier and transferred to the intermediate transfer belt includes a base member, an elastic layer laminated on the base member and a surface layer covering the elastic layer. With respect to the intermediate transfer belt, a volume resistivity of the surface layer is lower than a volume resistivity of an entirety of the intermediate transfer belt.

4 Claims, 5 Drawing Sheets

INTERMEDIATE TRANSFER BELT AND TANDEM COLOR IMAGE FORMING APPARATUS

INCORPORATION BY REFERENCE

This application is based upon and claims the benefit of priority from the corresponding Japanese Patent Application No. 2011-188538, filed in the Japan Patent Office on Aug. 31, 2011, the entire contents of which are incorporated herein by reference.

BACKGROUND

The present disclosure relates to an intermediate transfer belt that temporarily holds a toner image which is formed on an image carrier and transferred to the intermediate transfer belt, and a tandem color image forming apparatus provided with the same intermediate transfer belt.

Conventionally, color image forming apparatuses such as a color printer, color facsimile and the like have widely adopted a method, hereinafter referred to as "tandem method". The tandem method includes a primary transfer and a secondary transfer that is performed subsequent to the primary transfer. In the primary transfer, a toner image of each color (e.g., each of four colors, magenta, cyan, yellow, black) is primarily transferred from a plurality of image carriers (e.g. photoreceptor drums) arranged in tandem to an intermediate transfer belt. In the secondary transfer, the toner image on the intermediate transfer belt is secondarily transferred to a sheet of paper through a secondary transfer roller.

As one of problems which occur in a tandem color image forming apparatus using the intermediate transfer belt, a white spot image or a disordered image may be named, both of which are generated due to discharging performed during a secondary transfer. The disordered image is caused by the incomplete transfer of toner from the intermediate transfer belt to a surface of the sheet of paper due to a gap between them. To cope with such a problem, it is generally practiced that a coat layer (electrically high resistance layer) is formed on a surface of the secondary transfer roller to prevent the generation of discharging. In addition, an image forming apparatus has been known, which is provided with charging means for controlling an amount of electrostatic charge on toner existing on the intermediate transfer belt.

However, provision of the coat layer on the secondary transfer roller may lead to a new problem such as an increase in cost and a decrease in paper carrying performance and durability. Provision of any charging means may correspondingly increase the number of required components, thereby causing an increase in cost such as the case in which the coat layer is provided.

SUMMARY

The present disclosure provides an intermediate transfer belt and tandem type color image forming apparatus provided with the intermediate transfer belt, which prevents the occurrence of white spot images and disordered images so as to obtain excellent images while curbing a decrease in paper carrying performance and durability and an increase in cost.

According to an aspect of the present disclosure, an intermediate transfer belt that temporarily holds a toner image which is formed on an image carrier and transferred to the intermediate transfer belt includes a base member, an elastic layer laminated on the base member and a surface layer covering the elastic layer. With respect to the intermediate transfer belt, a volume resistivity of the surface layer is lower than a volume resistivity of an entirety of the intermediate transfer belt.

According to another aspect of the present disclosure, a tandem color image forming apparatus includes an intermediate transfer belt that temporarily holds a toner image which is formed on an image carrier and transferred to the intermediate transfer belt. The intermediate transfer belt includes a base member, an elastic layer laminated on the base member and a surface layer covering the elastic layer. With respect to the intermediate transfer belt, a volume resistivity of the surface layer is lower than a volume resistivity of an entirety of the intermediate transfer belt.

DETAILED DESCRIPTION

Figure 1:
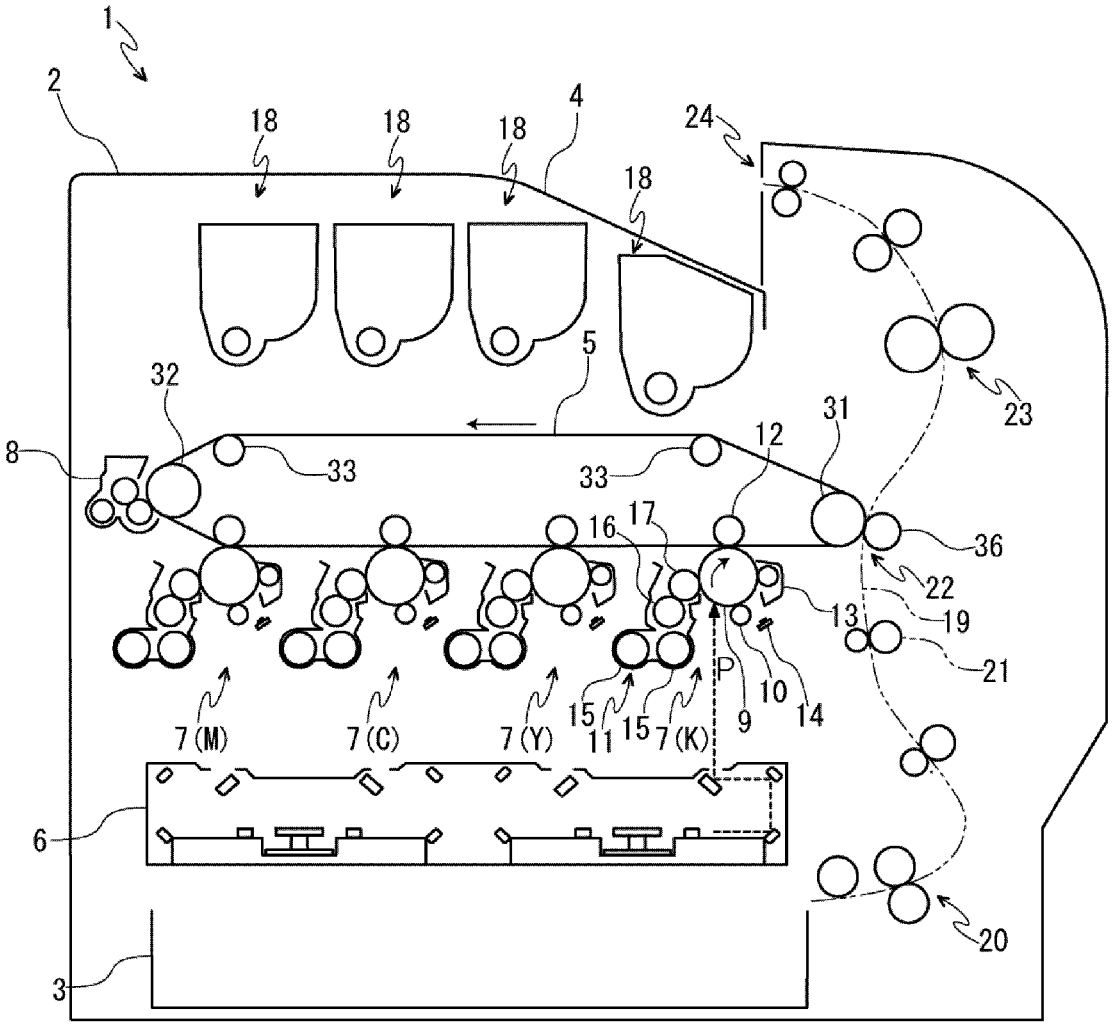
FIG. 1 is a schematic view illustrating a color printer according to an embodiment of the present disclosure.

First, an overall setup of a color printer 1, which is a tandem image forming apparatus, will be described with reference to FIG. 1. FIG. 1 is a schematic view illustrating the color printer according to an embodiment of the present disclosure.

The color printer 1 includes a printer main body 2 shaped like a box. A paper feeding cassette 3 accommodating sheets of paper (not illustrated) is provided at a bottom of the printer main body 2. A discharged paper tray 4 is provided at a top of the printer main body 2.

An intermediate transfer belt 5 is provided in an upper portion of the printer main body 2. The detail of the intermediate transfer belt will be described later. An exposure unit 6 constituted of a laser scanning unit (LSU) is disposed below the intermediate transfer belt 5. Four image forming units 7 for each of toner colors (e.g., magenta (M), cyan (C), yellow (Y), black (K) in sequence from the left) are provided along a bottom of the intermediate transfer belt 5. A cleaning unit 8 is provided at a left end of the intermediate transfer belt 5.

Each image forming unit 7 includes a rotatable photoreceptor drum 9 as an image carrier. An interval between adjacent photoreceptor drums 9 (pitch between the drums) is 94 mm, for example. A charger 10, developer 11, primary transfer roller 12, cleaning unit 13, and discharging unit 14 are arranged around each of the photoreceptor drums 9 in order of processing of a primary transfer. The primary transfer roller 12 is formed of, for example, a metallic shaft and epichlorohydrin rubber, having an outside diameter of 15 mm, and its electric resistance is 1 E+6 ($1\times10^6$)Ω (when 1000 V is applied).

A pair of agitation rollers 15 is provided in a lower portion of the developer 11. A magnetic roller 16 is provided obliquely above the pair of agitation rollers 15. A developing roller 17 is provided obliquely above the magnetic roller 16. Toner containers 18 for respective colors of the toners corresponding to the image forming units 7 are provided above developers 11.

A paper feeding path 19 is provided at a right side of the printer main body 2 (see the right side in FIG. 1). A feeding portion 20 is provided at an upstream end of the paper feeding path 19. A pair of registration rollers 21 is provided midway in the paper feeding path 19. A secondary transfer unit 22 is provided at a right end of the intermediate transfer belt 5 slightly downstream with respect to the pair of registration rollers 21. The detail of the secondary transfer unit 22 will be described later. A fixing unit 23 is provided downstream of the paper feeding path 19. A discharging port 24 is provided at a downstream end of the paper feeding path 19.

Next, an operation for forming an image performed by the color printer 1 described above will be explained. When the color printer 1 is powered on, various parameters are initialized and an initial setting such as setting of the temperature of the fixing unit 23 is executed. When an image data is input to the color printer 1 from a computer or the like connected to the color printer 1 and a print instruction is made, the color printer 1 executes the image forming operation as described below.

First, a surface of the photoreceptor drum 9 is charged by the charger 10. An exposure corresponding to the image data is implemented onto the photoreceptor drum 9 with a laser beam (see an arrow P) emitted from the exposure unit 6. Consequently, an electrostatic latent image is formed on the surface of the photoreceptor drum 9. Next, the developer 11 develops this electrostatic latent image to a toner image of a corresponding color using the toner. This toner image is primarily transferred to a surface of the intermediate transfer belt 5 by the primary transfer roller 12. Each of the image forming units 7 repeats in sequence the aforementioned operation, so that a full color toner image is temporarily held on the intermediate transfer belt 5. Toner and charge remaining on the photoreceptor drum 9 are removed by the cleaning unit 13 and the discharging unit 14.

On the other hand, a sheet of paper picked out of the paper feeding cassette 3 or a manual feeding tray (not illustrated) is fed to the secondary transfer unit 22 with a timing matched with the image forming operation described above. A full-color toner image on the intermediate transfer belt 5 is secondarily transferred to the sheet of paper at the secondary transfer unit 22. The sheet of paper to which the toner image has been secondarily transferred is carried downstream of the paper feeding path 19 and brought into the fixing unit 23, and then, the toner image is fixed in this fixing unit 23. The sheet of paper, on which the toner image has been fixed, is discharged onto the discharged paper tray 4 from the discharging port 24. In the present embodiment, the printing speed is, for example, 30 sheets of paper per minute (ppm). Toner remaining on the intermediate transfer belt 5 is removed by the cleaning unit 8.

Figure 2:
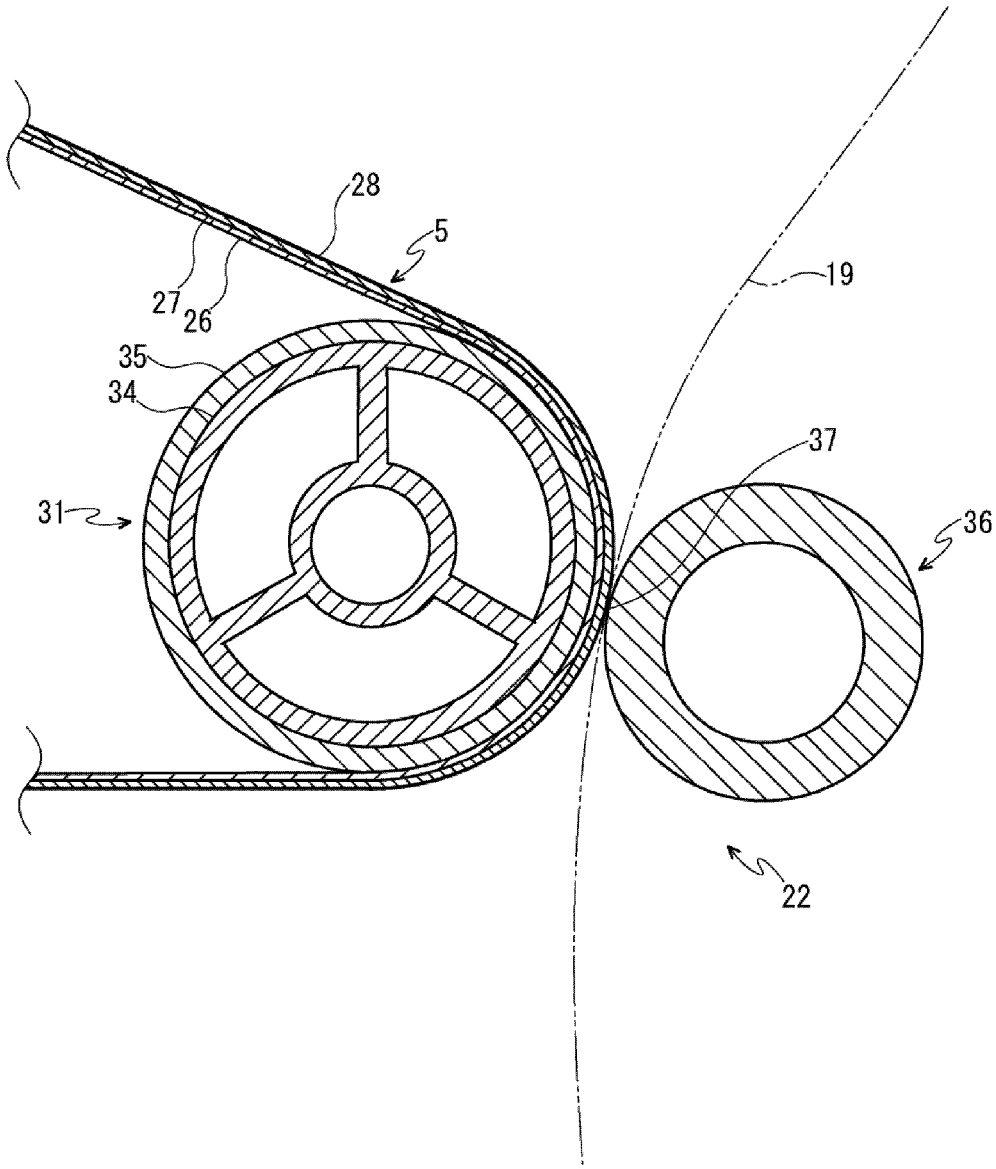
FIG. 2 is a cross-sectional view illustrating a vicinity of a secondary transfer unit in the color printer according to the embodiment of the present disclosure.

Next, the detail of the intermediate transfer belt 5 and the secondary transfer unit 22 will be described, mainly referring to FIG. 2. FIG. 2 is a cross-sectional view illustrating the vicinity of the secondary transfer unit in the color printer according to the embodiment of the present disclosure. In FIG. 2, the intermediate transfer belt 5 is represented in a larger thickness than that in reality in order to indicate the configuration of the intermediate transfer belt 5 in an easy-to-understand manner.

The intermediate transfer belt 5 will be described in detail. The intermediate transfer belt 5 includes a base member 26, elastic layer 27 laminated on the base member 26, and surface layer 28 (coat layer) which covers the elastic layer 27.

The base member 26 may be formed of, for example, polyvinylidene fluoride (Pvdf), which is a fluorine-based resin, in a thickness of 150 μm. A volume resistivity of the base member 26 may preferably be 10.0 (log Ω·cm) or more. As an example, a volume resistivity of 10.0 (log Ω·cm) may be adopted. By keeping the volume resistivity of the base member 26 at 10.0 (log Ω·cm) or more, it may be possible that both primary transfer performance and secondary transfer performance are maintained in excellent condition. Such a feature will be described in detail later.

The elastic layer 27 is formed of, for example, chloroprene rubber (CR), in a thickness of 250 μm. A volume resistivity of a complex in which the base member 26 is laminated with the elastic layer 27 (hereinafter referred to as "base member 26 plus elastic layer 27) may preferably be 10.0 (log Ω·cm) or more. As an example, a volume resistivity of 10.0 (log Ω·cm) may be adopted. When the volume resistivity of the base member 26 plus the elastic layer 27 is lower than 10.0 (log Ω·cm), it may be likely that a defect (unevenness and the like) on the surface layer 28 appears in a formed image.

The surface layer 28 is formed of, for example, polytetrafluoroethylene (PTFE), in order to achieve a better property of toner release. The surface layer 28 may preferably be formed in a thickness of several 1 μm to 20 μm. As an example, the surface layer 28 may be formed in a thickness of 5 μm. A volume resistivity of the surface layer 28 may preferably be 5.0 to 8.0 (log Ω·cm). As an example, a volume resistivity of 6.0 (log Ω·cm) may be adopted. When the volume resistivity of the surface layer 28 is lower than 5.0 (log Ω·cm), it may be likely that a defect (unevenness and the like) inherent on the surface layer 28 appears in a formed image. When the volume resistivity of the surface layer 28 is higher than 8.0 (log Ω·cm), it may be feared that a discharge occurs at the secondary transfer unit 22 and a defect such as white spot images occurs. Such a feature will be described later.

A volume resistivity of an entirety of the intermediate transfer belt 5 may preferably be 8.8 (log Ω·cm) or more. As an example, a volume resistivity of 9.7 (log Ω·cm) may be adopted. When the volume resistivity of the entire belt is lower than 8.8 (log Ω·cm), it may be that the primary transfer performance deteriorates, thereby leading to a cause of a defect in the formed image. Such a feature will be described later.

In this connection, it may be possible to control a principal ingredient contained in a resin to be used and an amount and dispersion state of electrically conductive material included as an additive, such that the volume resistivity of the intermediate transfer belt is appropriately adjusted.

It should be noted that the volume resistivity of the intermediate transfer belt is measurable with electrodes in accordance with Japanese Industrial Standard (JIS) K 6911.

More specifically, it may be possible to use an ohmmeter (commercial name Hiresta IP manufactured by Mitsubishi Chemical Co., LTD.) and electrodes (commercial name HR-100 manufactured by Mitsubishi Chemical Co., LTD.) with an applied voltage of 250V in accordance with JIS K 6911.

As illustrated in FIG. 1, the endless intermediate transfer belt 5 is wound with a tension applied thereto around a drive roller 31 provided at a right side of the printer main body 2, a driven roller 32 provided at a left side of the printer main body 2, a pair (left and right) of idle rollers 33 disposed inside the intermediate transfer belt 5 slightly above the drive roller 31 and the driven roller 32, and primary transfer rollers 12. In the present embodiment, the aforementioned tension is set to 20 N (newtons). The intermediate transfer belt 5 is configured to rotate in a direction of an arrow in FIG. 1 at a linear velocity of, for example, 150 mm/sec along with a rotation of the drive roller 31.

Next, the secondary transfer unit 22 will be described in detail. As illustrated in FIG. 2, the drive roller 31 is provided at the secondary transfer unit 22 such that a right end portion of the intermediate transfer belt 5 is wound on the drive roller 31. The drive roller 31 is formed in a diameter of, for example, 29.4 mm, and composed of a roller main body 34 having aluminum three radial ribs and a resin layer 35 provided on a periphery of the roller main body 34. A volume resistivity of the roller main body 34 is 12.0 (log Ω·cm).

A secondary transfer roller 36 is provided at the secondary transfer unit 22. In cooperation with the drive roller 31, the secondary transfer roller 36 sandwiches the intermediate transfer belt 5. A secondary transfer nip 37 is formed between the secondary transfer roller 36 and the intermediate transfer belt 5. A full color toner image held temporarily on the intermediate transfer belt 5 is secondarily transferred to a sheet of paper at the secondary transfer nip 37. The secondary transfer roller 36 is formed of a metallic shaft and epichlorohydrin rubber in an outside diameter ϕ of 20 mm and an electric resistance value thereof is 1 E+7 ($1\times10^7$)Ω (when 1000 V is applied). The secondary transfer roller 36 is not provided with a coat layer.

Effects achieved by the intermediate transfer belt 5 with the above-described configuration will be described below.

Since the volume resistivity 6.0 (log Ω·cm) of the surface layer 28 is lower than the volume resistivity 9.7 (log Ω·cm) of the entire belt, it may be possible in the intermediate transfer belt 5 of the present embodiment to prevent a rise in the amount of electrostatic charges taken by the toner on the surface layer 28. Accordingly, it may be possible to control an occurrence of discharge at the secondary transfer unit 22, thereby preventing an occurrence of white images and disordered images. As a result, it may be possible to obtain an excellent image. In addition, since it may be possible to prevent the occurrence of the white spot images and disordered images without any coating layer on the secondary transfer roller 36 or additional charging means, no such problems as an increase in cost, decrease in paper carrying performance and durability will occur.

In the present embodiment, as the volume resistivity of the surface layer 28, 6.0 (log Ω·cm) is selected, for example, such that the volume resistivity is set to 8.0 (log Ω·cm) or less. An effect of this setting will be described with reference to FIGS. 3 and 4.

Figure 3:
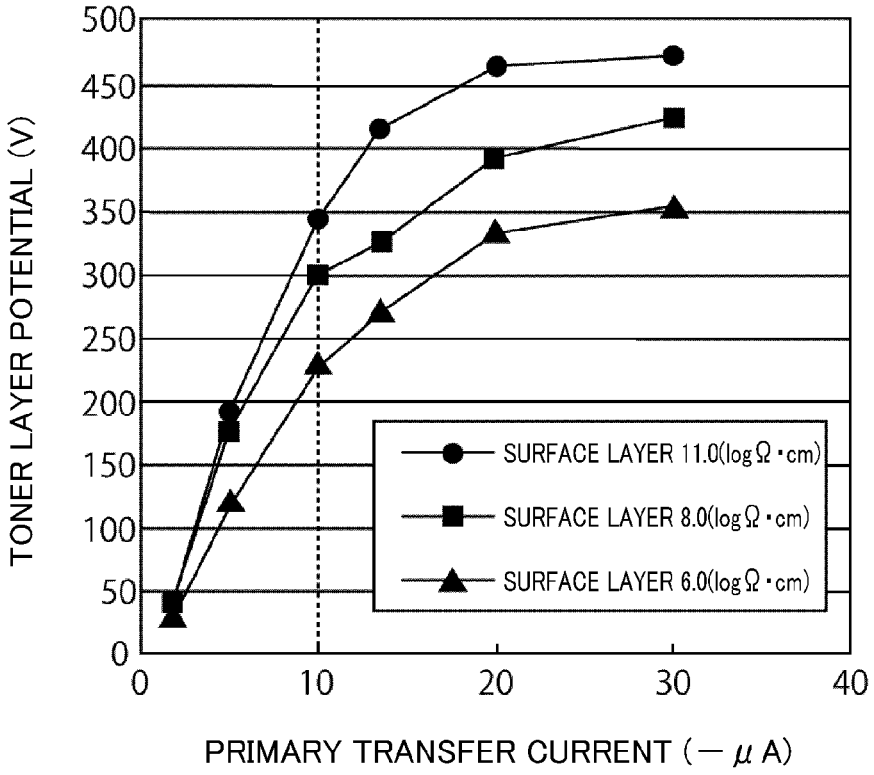
FIG. 3 is a graph illustrating a relationship between primary transfer current and toner layer potential.

FIG. 3 is a graph illustrating a relationship between the primary transfer current and the toner layer potential. As illustrated in FIG. 3, when the primary transfer current increases, the toner layer potential on the intermediate transfer belt 5 increases, accordingly. When the volume resistivity of the surface layer 28 gradually decreases 11.0, 8.0 and 6.0 (log Ω·cm), an increase in the toner layer potential on the intermediate transfer belt 5 is suppressed, accordingly.

Figure 4:
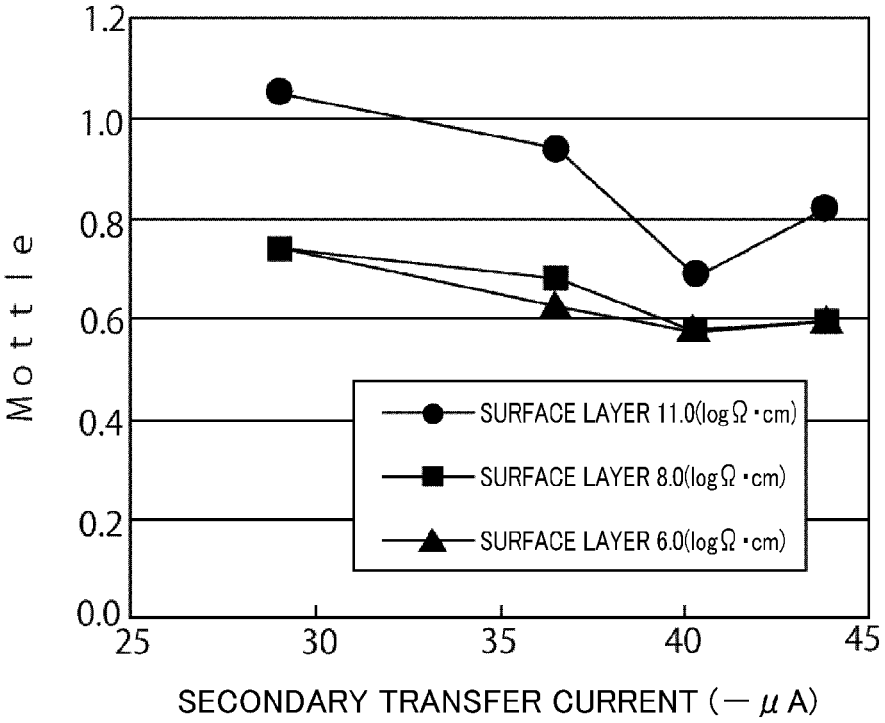
FIG. 4 is a graph illustrating a relationship between secondary transfer current and mottles.

FIG. 4 is a graph illustrating a relationship between the secondary transfer current and generated mottles. "Mottle" refers to the degree of generated mottles, indicating a fluctuation of the density of a low spatial frequency domain in a solid image area. More specifically, an image measurement area is divided to small areas (412 μm×412 μm) which correspond to a spatial frequency in the fluctuation of the density. A standard deviation relative to $D_{ij}$ is defined as mottle, where an average density of each area is defined as $D_{ij}$. The mottle is expressed as:

$$\text{Mottle} = \sqrt{\frac{1}{nm-1}\sum_{i=1}^{n}\sum_{j=1}^{m}(D_{ij}-\overline{D})^2}$$

The mottle serves as an index of the rate of occurrence of white spot images and the like.

By decreasing the volume resistivity of the surface layer 28 as described above, a rise in toner layer potential on the intermediate transfer belt 5 is suppressed, so that the value of the mottle drops as illustrated in FIG. 4. Consequently, it is found that the occurrence of such a defect as the white spot images can be prevented by reducing the volume resistivity of the surface layer 28.

Even if the volume resistivity of the surface layer 28 decreases from 8.0 to 6.0 (log Ω·cm) as illustrated in FIG. 4, there is not a noticeable difference in the value of the mottle. In contrast, it is found that when the volume resistivity of the surface layer 28 decreases from 11.0 to 8.0 (log Ω·cm), the value of the mottle drops remarkably. As anticipated from the above, when the volume resistivity of the surface layer 28 is set to 8.0 (log Ω·cm) or less like the present embodiment, it may be possible to prevent the occurrence of discharge at the secondary transfer unit 22, so that the occurrence of such a defect as the white spot images may be prevented.

In the present embodiment, as the volume resistivity of the entire belt, 9.7 (log Ω·cm) is selected, for example, to satisfy 8.8 (log Ω·cm) or more. Effects obtained by this setting will be described with reference to FIGS. 5 and 6.

Figure 5A:
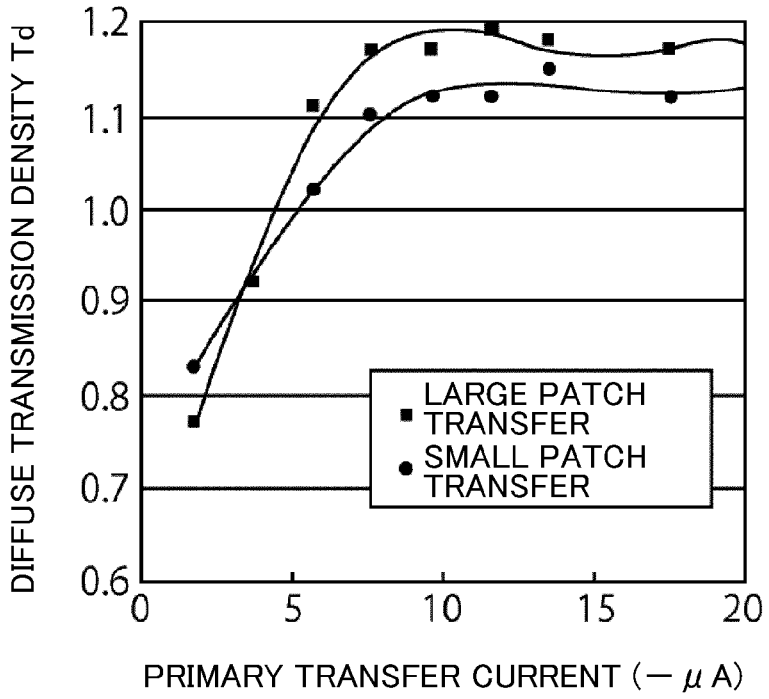
FIG. 5A is a graph illustrating a relationship between primary transfer current and diffuse transmission density when a volume resistivity of an entire belt is 8.8 log Ω·cm.
Figure 5B:
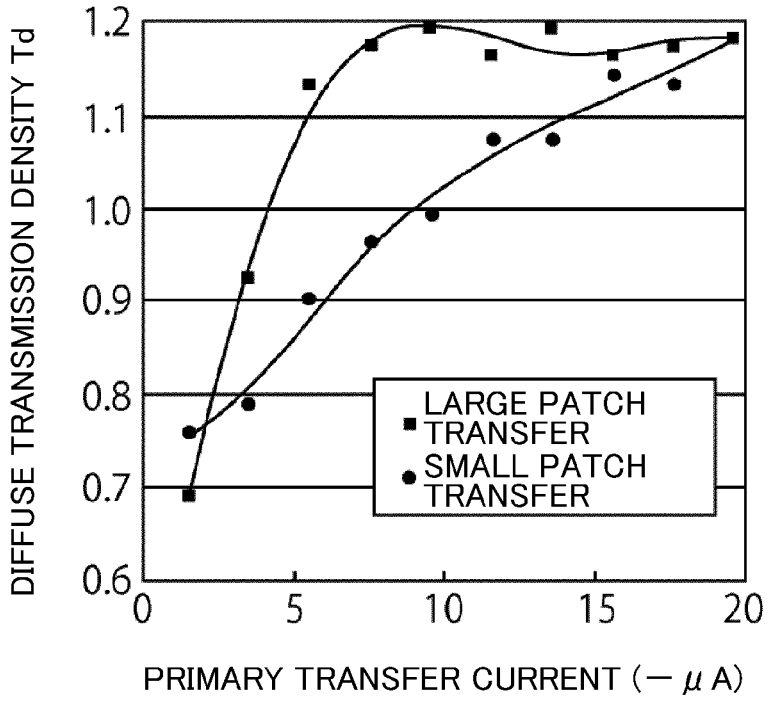
FIG. 5B is a graph illustrating a relationship between primary transfer current and diffuse transmission density when the volume resistivity of the entire belt is 7.8 log Ω·cm.
Figure 6:
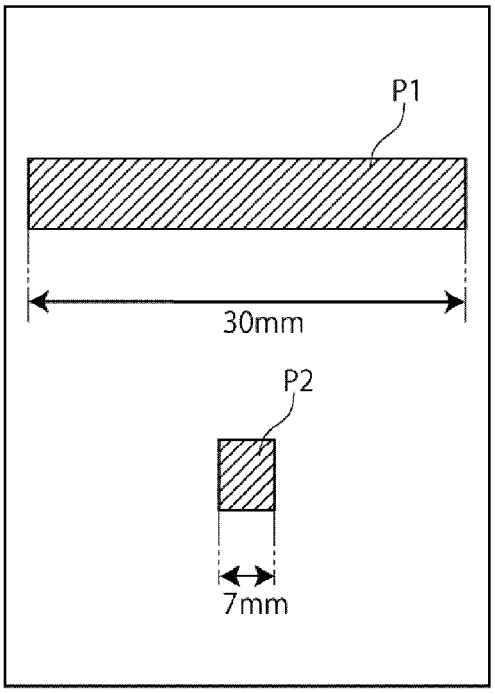
FIG. 6 is an explanatory diagram illustrating a large patch and a small patch.

FIG. 5A is a graph illustrating a relationship between the primary transfer current and a diffuse transmission density when the volume resistivity of an entire belt is 8.8 log Ω·cm. FIG. 5B is a graph illustrating a relationship between the primary transfer current and the diffuse transmission density when the volume resistivity of the entire belt is 7.8 log Ω·cm. A vertical axis in each of FIGS. 5A and 5B indicates the diffuse transmission density in an image forming unit 7 for a cyan color. "Large patch transfer" described in FIGS. 5A and 5B refers to a primary transfer of a large patch (a toner image 30 mm wide, see P1 in FIG. 6) from the photoreceptor drum 9 to the intermediate transfer belt 5. "Small patch transfer" described in FIGS. 5A and 5B refers to a primary transfer of a small patch (a toner image 7 mm wide, see P2 in FIG. 6) from the photoreceptor drum 9 to the intermediate transfer belt 5. A diffuse transmission density on the vertical axis of the graph indicates measurement values obtained with a Transmission/Reflection Densitometer (Model 310TR) manufactured by X-Rite.

As illustrated in FIGS. 5A and 5B, there is not a noticeable difference in the diffuse transmission density in case of the large patch transfer between when the volume resistivity of the entire belt is 8.8 (log Ω·cm) in FIG. 5A and when the volume resistivity of the entire belt is 7.8 (log Ω·cm) in FIG. 5B. On the other hand, in case of the small patch transfer, the diffuse transmission density for a case where the volume resistivity of the entire belt is 8.8 (log Ω·cm) is remarkably larger than that for a case where the volume resistivity of the entire belt is 7.8 (log Ω·cm). The reason for the phenomenon described above is that an electric field for transferring a toner image has escaped to an area where no toner exists around a small patch while the small patch is being transferred. What is described above demonstrates that it may be possible to appropriately maintain the primary transfer performance by setting the volume resistivity of the entire belt to 8.8 (log Ω·cm) or more like the present embodiment.

Figure 7:
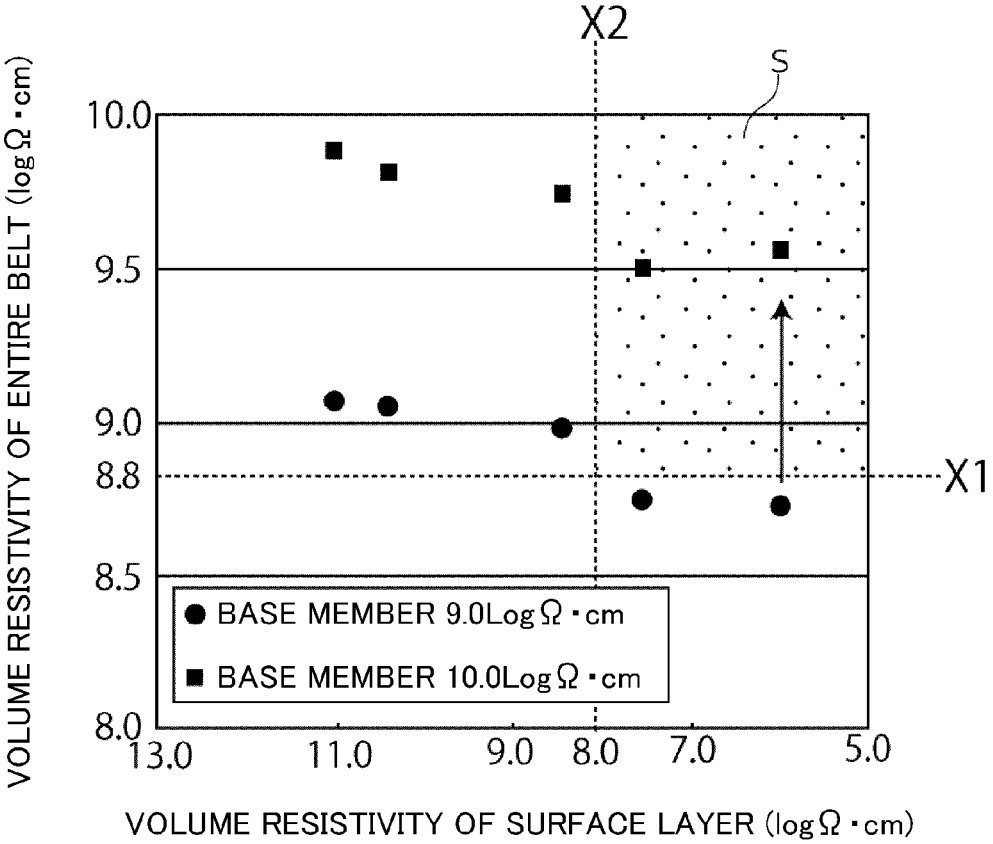
FIG. 7 is a graph illustrating a relationship between a volume resistivity of a surface layer and a volume resistivity of an entire belt.

In the present disclosure, 10.0 (log Ω·cm) is selected as a volume resistivity of the base member 26 so that the volume resistivity is set to 10.0 (log Ω·cm) or more. Effects achieved by this setting will be described with reference to FIG. 7. FIG. 7 is a graph illustrating a relationship between a volume resistivity of a surface layer and a volume resistivity of an entire belt.

In FIG. 7, a dotted line X1 indicates a lower limit value 8.8 (log Ω·cm) of a volume resistivity of the entire belt necessary for maintaining the primary transfer performance. A dotted line X2 indicates an upper limit value 8.0 (log Ω·cm) of a volume resistivity of the surface layer 28 necessary for maintaining the secondary transfer performance. That is, in FIG. 7, an area S above the dotted line X1 and on the right side of the dotted line X2 is an area appropriate for both primary and secondary transfer performance.

When a volume resistivity of the base member 26 is 9.0 (log Ω·cm) as illustrated in FIG. 7, one of the primary transfer performance and the secondary transfer performance is not satisfactory whichever volume resistivity of the surface layer 28 is set (a volume resistivity does not fall within the area S). In contrast, for a case where the volume resistivity of the base member 26 is 10.0 (log Ω·cm) both the primary transfer performance and the secondary transfer performance are appropriately maintained (a volume resistivity falls within the area S) when the volume resistivity of the surface layer 28 is set to 8.0 or less. Accordingly, it may be preferable to set the volume resistivity of the base member to 10.0 (log Ω·cm) or more like the present embodiment, in order to appropriately maintain both the primary transfer performance and the secondary transfer performance.

As described above, if the volume resistivity of the surface layer 28 is set lower than the volume resistivity of the entire belt and the volume resistivity of each of the layers (base member 26, elastic layer 27, surface layer 28) constituting the intermediate transfer belt 5 is appropriately set, it may be possible to control the amount of electrostatic charges taken by the toner on the intermediate transfer belt 5. In this manner, it may be possible to obtain an excellent transferred image.

In the present embodiment, the descriptions have been made for the case where the base member 26 of the intermediate transfer belt 5 is formed of polyvinylidene fluoride (Pvdf). However, it may alternatively be possible that the base member 26 is formed of different material such as polyimide, polycarbonate and the like. Further, in the present embodiment, the descriptions have been made for the case where the elastic layer 27 of the intermediate transfer belt is formed of CR rubber. However, it may alternatively be possible that the elastic layer 27 is formed of different material such as nitrile rubber (NBR), silicon, urethane and the like. Additionally, in the present embodiment, the descriptions have been made for the case where the surface layer 28 of the intermediate transfer belt 5 is formed of PTFE. However, it may alternatively be possible that the surface layer 28 is formed of different material. That is, as far as the volume resistivity of the surface layer 28 is set lower than the volume resistivity of the entire belt, it may be possible to apply any combination of materials to manufacturing of the base member 26, elastic layer 27 and surface layer 28.

In the present embodiment, the descriptions have been made for the case where the setup of the present disclosure is applied to the color printer 1. However, it may alternatively be possible to apply the setup of the present disclosure to other image forming apparatuses such as a copy machine, digital multi-functional peripheral, facsimile machine and the like.

The invention claimed is:

1. An intermediate transfer belt that temporarily holds a toner image which is formed on an image carrier and transferred to the intermediate transfer belt, comprising:
- a base member;
- an elastic layer laminated on the base member;
- and an outermost surface layer on which the toner image transferred from the image carrier is temporarily held covering the elastic layer,
- wherein a volume resistivity of the surface layer is configured to be lower than a volume resistivity of an entirety of the intermediate transfer belt and less than 8.0 (log Ω·cm).

2. The intermediate transfer belt according to claim 1, wherein the volume resistivity of the entirety of the intermediate transfer belt is 8.8 (log Ω·cm) or more.

3. The intermediate transfer belt according to claim 1, wherein the volume resistivity of the base member is 10.0 (log Ω·cm) or more.

4. A tandem color image forming apparatus comprising:
- an intermediate transfer belt that temporarily holds a toner image which is formed on an image carrier and transferred to the intermediate transfer belt,
- wherein the intermediate transfer belt comprises:
  - a base member;
  - an elastic layer laminated on the base member;
  - and an outermost surface layer on which the toner image transferred from the image carrier is temporarily held covering the elastic layer,
  - wherein a volume resistivity of the surface layer is configured to be lower than a volume resistivity of an entirety of the intermediate transfer belt and less than 8.0 (log Ω·cm).

* * * * *